US007622906B2

(12) United States Patent
Kushima et al.

(10) Patent No.: US 7,622,906 B2
(45) Date of Patent: Nov. 24, 2009

(54) REFERENCE VOLTAGE GENERATION CIRCUIT RESPONSIVE TO AMBIENT TEMPERATURE

(75) Inventors: Takahito Kushima, Osaka (JP); Tomokazu Kojima, Osaka (JP)

(73) Assignee: Panasonic Corporation, Osaka (JP)

( * ) Notice: Subject to any disclaimer, the term of this patent is extended or adjusted under 35 U.S.C. 154(b) by 97 days.

(21) Appl. No.: 11/867,332

(22) Filed: Oct. 4, 2007

(65) Prior Publication Data

US 2008/0180070 A1 Jul. 31, 2008

(30) Foreign Application Priority Data

Oct. 24, 2006 (JP) ..... 2006-289257

(51) Int. Cl.
*G05F 3/20* (2006.01)
*G05F 3/16* (2006.01)

(52) U.S. Cl. ..... 323/316; 323/313; 323/314; 323/315

(58) Field of Classification Search ..... 323/313, 323/314, 315
See application file for complete search history.

(56) References Cited

U.S. PATENT DOCUMENTS 4,538,199 A * 8/1985 Bielinski et al. ..... 361/93.8
5,239,453 A * 8/1993 Remson ..... 363/19
6,160,391 A 12/2000 Banba
6,958,597 B1 * 10/2005 Lin et al. ..... 323/313
2004/0008080 A1 1/2004 Nagaya

FOREIGN PATENT DOCUMENTS

EP 0895147 5/2002
JP 1145125 2/1999

OTHER PUBLICATIONS

English language Abstract of JP 11-45125.

* cited by examiner

*Primary Examiner*—Bao Q Vu
(74) *Attorney, Agent, or Firm*—Greenblum & Bernstein P.L.C.

(57) ABSTRACT

An object of the invention is to provide a reference voltage generation circuit relatively unaffected by ambient temperature, capable of supplying reference voltage equal to or less than the bandgap voltage of silicon. The reference voltage generation circuit includes: a current generation circuit which generates current; and a current-voltage conversion circuit which converts the current generated by said current generation circuit into voltage to generate reference voltage. The current generation circuit generates current which varies in value according to ambient temperature of the current generation circuit. The current-voltage conversion circuit includes two resistors, in which the current generated by the said current generation circuit flows, and which perform voltage conversion. One of the resistors has a positive temperature coefficient and the other has a negative temperature coefficient.

7 Claims, 8 Drawing Sheets

REFERENCE VOLTAGE GENERATION CIRCUIT RESPONSIVE TO AMBIENT TEMPERATURE

BACKGROUND OF THE INVENTION (1) Field of the Invention

The present invention relates to a reference voltage generation circuit composed of MOS transistors.

(2) Description of the Related Art

In recent years, reference voltage generation circuits are used for the purpose of providing stable reference voltage which is not affected by temperature variation and power supply voltage variation. As the reference voltage generation circuit, there are various types of circuits; but a bandgap reference circuit is often used which uses the bandgap voltage of semiconductor material (for example, refer to Japanese Unexamined Patent Application Publication No. 11-45125). The bandgap reference circuit generates stable reference voltage by use of bandgap voltage characteristics of semiconductor material. The bandgap reference circuit will be described below.

The bandgap voltage of semiconductor material is a physical constant at absolute zero temperature; for example, the bandgap voltage of silicon has a value of about 1.24 V. As the temperature of semiconductor material rises from absolute zero, the bandgap energy of semiconductor material decreases and thus a negative temperature coefficient appears. Consequently, the forward bias voltage across PN junction where a P-type semiconductor and a N-type semiconductor are bonded decreases as the temperature of semiconductor material rises, its reduction rate depending on the cross sectional area of the PN junction and the semiconductor material used. As a result, in two PN junctions composed of the same semiconductor material and having a different cross sectional area of PN junction, when the temperatures of the two PN junctions vary, the forward bias voltages across the two PN junctions vary at a different rate. The bandgap reference circuit uses the voltage relationship between these two PN junctions each biased in a forward direction to output reference voltage relatively non-sensitive to temperature.

With reference to FIG. 1, the operation of the bandgap reference circuit will now be described. FIG. 1 is a circuit diagram of a constant voltage circuit using a conventional bandgap reference circuit.

The bandgap reference circuit 100 has, as illustrated in FIG. 1, a current generation circuit 14 and current-voltage conversion circuit 24.

The current generation circuit 14 includes: P-channel MOS transistors MP12 and MP13 constituting a first current mirror circuit; N-channel MOS transistors MN9 and MN10 constituting a second current mirror circuit; diodes D3 and D4; and a resistor 15 of a resistance value R10. Here, current generated by the current generation circuit 14 is calculated. When the Boltzmann constant is k, absolute temperature is T, the elementary charge quantity of electron is q, the junction areas S of the diodes D3 and D4 are S3 and S4, respectively, and the area ratio S4/S3 is N, then drain-source current IP13 of the P-channel MOS transistors MP12 and MP13 is expressed as $$IP13=(1/R10)\cdot(kT/q)\cdot\ln(N) \quad (1).$$

The current-voltage conversion circuit 24 includes: a P-channel MOS transistor MP14; a resistor 16 of a resistance value R11; a diode D5; and an operational amplifier 71, and performs a function of converting constant current IP13 supplied from the current generation circuit 14 into voltage.

In the bandgap reference circuit 100 having the above configuration, an output voltage after the current-voltage conversion can be extracted from a node to which the resistor 16 and the drain terminal of the P-channel MOS transistor MP14 are connected. When the voltage of this node is reference voltage (bandgap output voltage) Vref and the forward voltage of the diode D5 is VF, then reference voltage Vref is expressed as $$V\mathrm{ref}=(R11/R10)\cdot(kT/q)\cdot\ln(N)+VF \quad (2).$$

The bandgap reference circuit 100 is characterized by being stable against ambient temperature variation. Thus, the variation of reference voltage Vref with respect to ambient temperature will now be described. The relationship formula between ambient temperature T and the variation of reference voltage Vref is expressed as $$\partial V\mathrm{ref}/\partial T=R11/R10\cdot(k/q)\cdot\ln(N)+\partial VF/\partial T \quad (3).$$

In formula (3), when proper values are selected for the resistance of the resistors 15 and 16 and the junction area ratio N between the diodes D3 and D4, there can be obtained reference voltage Vref being output voltage relatively unaffected by temperature. More specifically, when the negative temperature coefficient relating to the PN junction of the diode D5 in the second term in the right-hand side of formula (3) is balanced with the positive temperature coefficient relating to the difference of PN junction in the first term in the right-hand side of formula (3), a reference voltage Vref not affected by temperature can be obtained.

When a circuit composed of transistors and diodes of this type is designed, the characteristics of the transistors and diodes may vary depending on the processes. When the characteristics of the devices vary, the stability of reference voltage may be reduced. Accordingly, when voltage accuracy must be ensured, reference voltage must be calibrated by use of a fuse trimming circuit. Consequently, in the constant voltage circuit of FIG. 1, a fuse trimming circuit 45 is connected to the current-voltage conversion circuit 24. That is, trimming resistors 17 and 18 having resistance values R12 and R13 are arranged as resistors for calibration. When the output voltage of the operational amplifier 71 is Vbgr, voltage Vtrim obtained after fuse trimming is expressed as $$V\mathrm{trim}=\{R13/(R12+R13)\}\cdot Vbgr \quad (4).$$

Here, the operational amplifier 71 is an impedance conversion device, and reference voltage Vref and output voltage Vbgr have the same value, exclusive of offset voltage of the operational amplifier 71. As a result, when the resistance values of the resistors 17 and 18 can be varied, calibration can be made for the variation caused by process variations, and voltage equal to or less than reference voltage Vref can be outputted. In this case, the output voltage Vout of the operational amplifier 71 is expressed as $$V\mathrm{out}=V\mathrm{trim}=\{R13/(R12+R13)\}\cdot\{(R11/R10)\cdot(kT/q)\cdot\ln(N)+VF\} \quad (5).$$

Note that, in the constant voltage circuit of FIG. 1, there is arranged an operational amplifier 72 acting as an impedance converter for transmitting output voltage Vtrim to a subsequent stage. However, when the input impedance of the subsequent stage is sufficiently high, the operational amplifier 72 does not need to be arranged.

SUMMARY OF THE INVENTION

In the conventional constant voltage circuit using the bandgap reference circuit illustrated in FIG. 1, reference voltage Vref is substantially fixed to the bandgap voltage of silicon. Consequently, in order to extract voltage equal to or less than the bandgap voltage of silicon, the operational amplifiers 71 and 72 and the resistors 17 and 18 are arranged. As a result, the layout area occupied by the constant voltage circuit increases.

Thus, the present invention has been devised in order to solve the above problem and its object is to provide a reference voltage generation circuit relatively unaffected by ambient temperature, capable of supplying reference voltage equal to or less than the bandgap voltage of silicon.

In order to achieve the above object, the reference voltage generation circuit includes: a current generation circuit which generates current; and a current-voltage conversion circuit which converts the current generated by the current generation circuit into voltage to generate reference voltage, wherein the current generation circuit generates current which varies in value according to ambient temperature of the current generation circuit, the current-voltage conversion circuit has a first resistor and a second resistor in which the current generated by the current generation circuit flows, and one of the first resistor and the second resistor has a positive temperature coefficient and the other has a negative temperature coefficient. Here, the current generation circuit includes: a first diode connected in series between a first node and a ground node; a second diode and a third resistor connected in series between a second node and a ground node; and a feedback circuit, connected in series between a power source node and the first node and between a power source node and the second node, and performing control so as to make a potential of the first node equal to a potential of the second node, the current-voltage conversion circuit further includes an input circuit, connected in series between a reference voltage node which generates reference voltage and a power source node, into which the current generated by the current generation circuit is inputted, the first resistor may be connected in series between the reference voltage node and a third node, and the second resistor is connected in series between the third node and a ground node.

According to the present invention, there can also be provided a reference voltage generation circuit including: a current generation circuit which generates current; and a current-voltage conversion circuit which converts the current generated by the current generation circuit into voltage to generate reference voltage, wherein the current generation circuit is a circuit that generates current which varies in value according to ambient temperature of the current generation circuit, the current generation circuit including: a first diode connected in series between a first node and a ground node; a second diode and a third resistor connected in series between a second node and a ground node; and a feedback circuit, connected in series between a power source node and the first node and between a power source node and the second node, and performing control so as to make a potential of the first node equal to a potential of the second node, and wherein the current-voltage conversion circuit includes: a first input circuit, connected in series between a fourth node and a power source node, and receiving the current generated by the current generation circuit; an operational amplifier having an inverting input terminal connected to the fourth node; a second input circuit, connected in series between a non-inverting input terminal of the operational amplifier and a power source node, and receiving the current generated by the current generation circuit; a fifth resistor connected between the inverting input terminal and an output terminal of the operational amplifier; a sixth resistor connected in series between the non-inverting input terminal of the operational amplifier and a power source node; a seventh node connected in series between the fourth node and a power source node; and an eighth resistor connected in series between the fourth node and the inverting input terminal of the operational amplifier, at least one of the fifth resistor, the sixth resistor, the seventh resistor, and the eighth resistor having a positive temperature coefficient, and at least one of the other resistors having a negative temperature coefficient.

Accordingly, there can be implemented the reference voltage generation circuit, relatively unaffected by ambient temperature, and supplying reference voltage equal to or less than the bandgap voltage of silicon. As a result, the layout area occupied by the constant voltage circuit can be reduced, compared to when the bandgap reference circuit is used.

Additionally, at least one of the first resistor and the second resistor may be a transistor which operates in a non-saturation region.

Accordingly, the first resistor and second resistor can be composed of a transistor requiring a relatively small layout area, allowing chip area reduction.

Additionally, the third resistor may be a transistor which operates in a non-saturation region.

Accordingly, the third resistor can be a transistor requiring a relatively small layout area, allowing chip area reduction.

The current generation circuit may include: a current mirror circuit which is connected in series between a first node and a power source node and between a second node and a power source node and which performs control so that current flowing in the second node becomes an integer multiple of current flowing in the first node; and a fourth resistor connected in series between the second node and a ground node, the current-voltage conversion circuit further includes an input circuit, connected in series between a reference voltage node which generates reference voltage and a power source node, into which mirror current of the current mirror circuit is inputted, the first resistor is connected in series between the reference voltage node and a third node, and the second resistor is connected in series between the third node and a ground node.

Accordingly, the number of diodes conventionally needed in the constant current source generation circuit can be reduced, allowing chip area reduction. Note that, the current value of the current generation circuit is affected by variations in transistor manufacturing processes.

Additionally, at least one of the resistor having the positive temperature coefficient and the resistor having the negative temperature coefficient may be any of a variable resistor and a trimming circuit.

Accordingly, the resistance value of the first resistor and second resistor can be varied, so adjustment can easily be made so that the reference voltage becomes equal to or less than the bandgap voltage of silicon.

According to the reference voltage generation circuit of the present invention, voltage equal to or less than the bandgap voltage of silicon can be outputted, which is hardly affected by ambient temperature. Accordingly, the layout area occupied can be reduced, compared to conventional constant voltage circuits.

FURTHER INFORMATION ABOUT TECHNICAL BACKGROUND TO THIS APPLICATION

The disclosure of Japanese Patent Application No. 2006-289257 filed on Oct. 24, 2006 including specification, drawings and claims is incorporated herein by reference in its entirety.

BRIEF DESCRIPTION OF THE DRAWINGS

These and other objects, advantages and features of the invention will become apparent from the following description thereof taken in conjunction with the accompanying drawings that illustrate a specific embodiment of the invention. In the Drawings.

DESCRIPTION OF THE PREFERRED EMBODIMENT(S)

A reference voltage generation circuit according to embodiments of the present invention will be specifically described below with reference to the drawings.

First Embodiment

Figure 1:
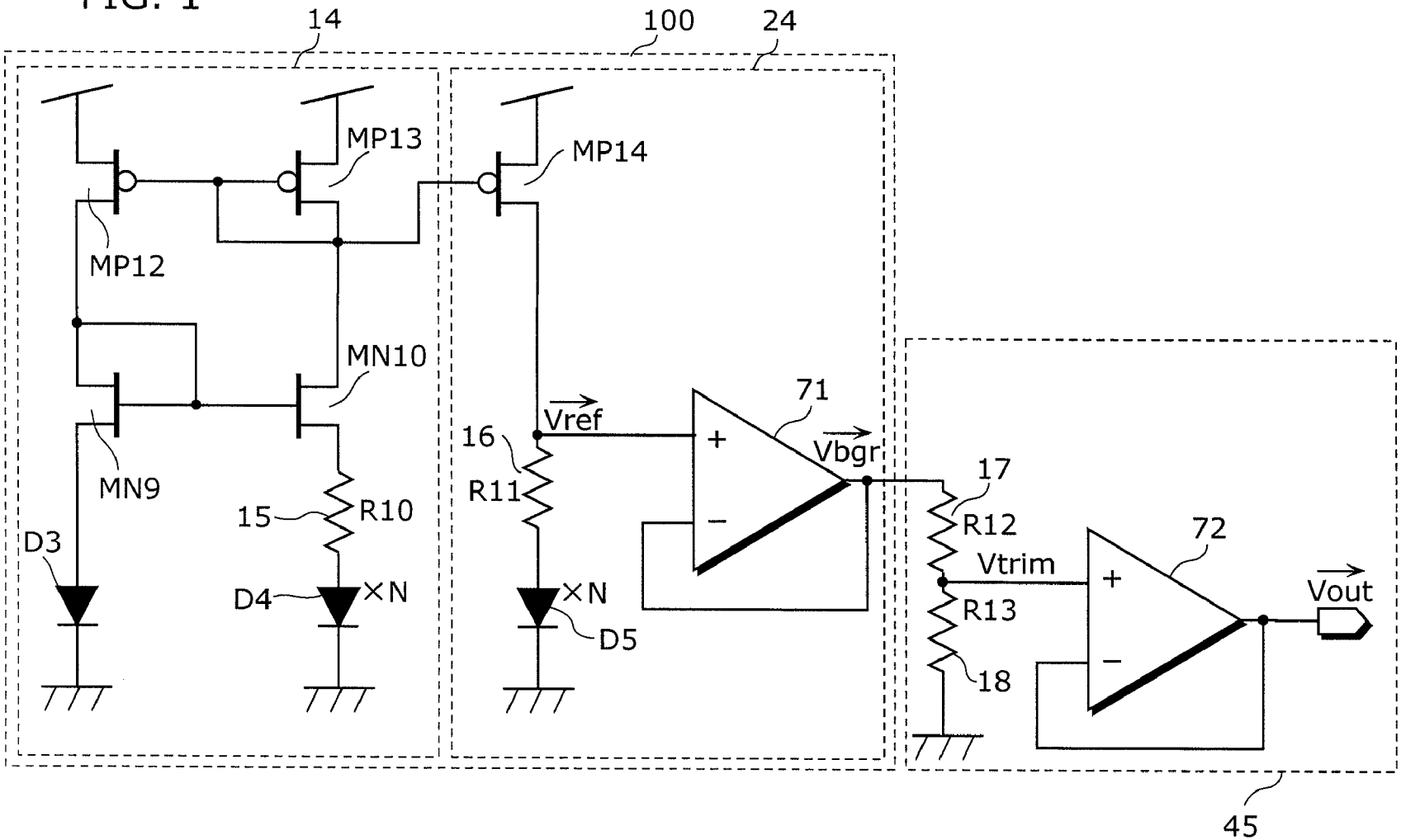
FIG. 1 is a circuit diagram illustrating a configuration of a conventional reference voltage generation circuit.
Figure 2:
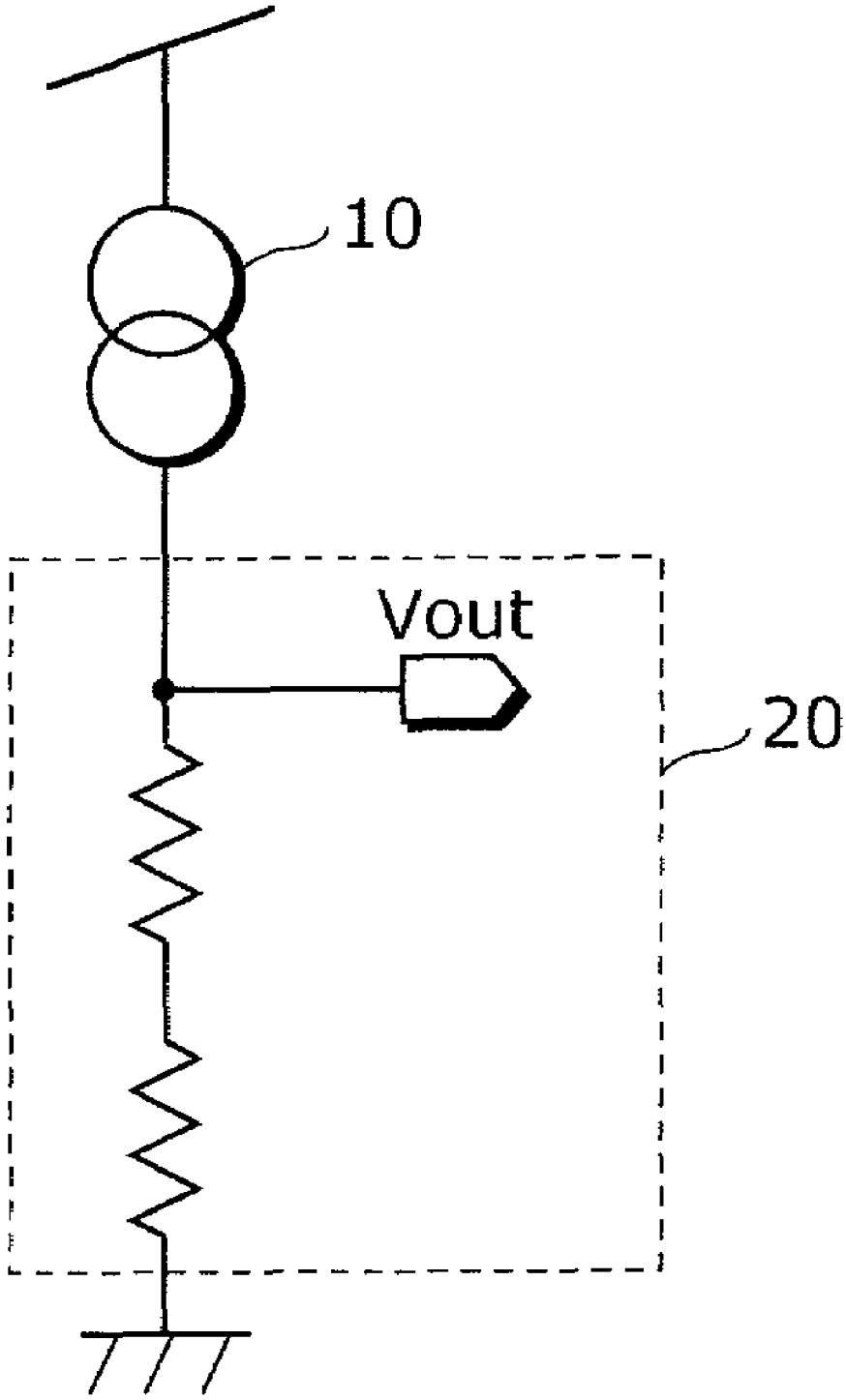
FIG. 2 is a view illustrating a schematic configuration of a reference voltage generation circuit according to a first embodiment of the present invention.
Figure 3:
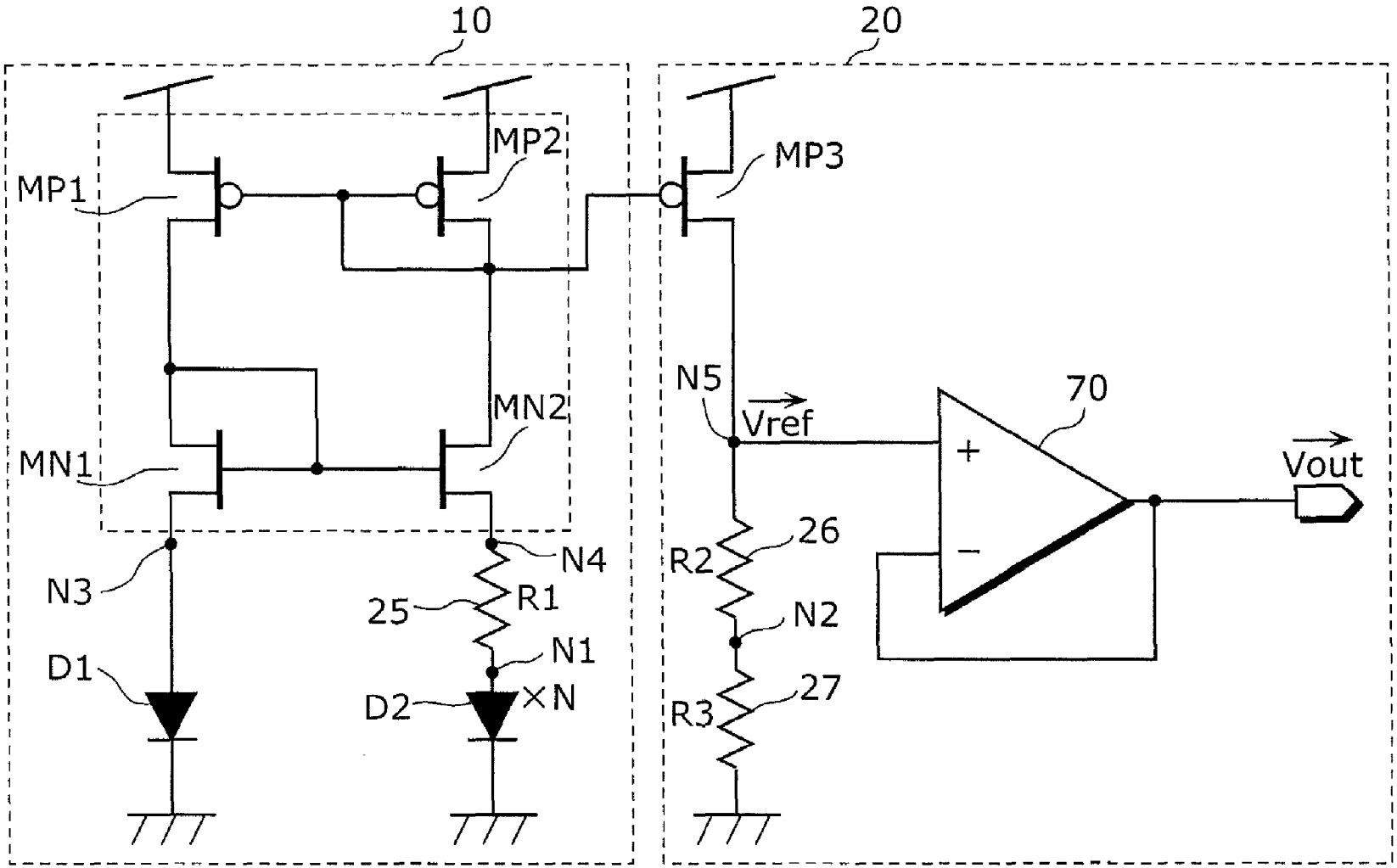
FIG. 3 is a circuit diagram illustrating a configuration of the reference voltage generation circuit according to the first embodiment.

FIG. 2 is a view illustrating a schematic configuration of a reference voltage generation circuit according to the present embodiment; and FIG. 3 is a circuit diagram of the reference voltage generation circuit.

This reference voltage generation circuit is composed of: a current generation circuit 10 which generates current which varies in value according to ambient temperature of the current generation circuit 10; and a current-voltage conversion circuit 20 which converts the current generated by the current generation circuit 10 into voltage to generate reference voltage.

The current generation circuit 10 is composed of: P-channel MOS transistors MP1 and MP2 constituting a first current mirror circuit; N-channel MOS transistors MN1 and MN2 constituting a second current mirror circuit; a diode D1 connected between the source of the N-channel MOS transistor MN1 and the ground; and a resistor 25 of a resistance value R1 and a diode D2 connected in series between the source of the N-channel MOS transistor MN2 and the ground. The diode D2 is composed of a number N of diodes connected in parallel. Reference characters S1 and S2 denote the junction areas of the diodes D1 and D2, respectively; reference character N denotes the area ratio S2/S1.

Here, the diode D1 is connected in series between a first node N3 and a ground node, and the diode D2 and resistor 25 are connected in series between a second node N4 and a ground node. The first and second current mirror circuits are connected in series between a power source node and the first node N3 and between a power source node and the second node N4, and perform control so that current flowing in the second node N4 becomes an integer multiple of current flowing in the first node N3. The first and second current mirror circuits constitute a feedback circuit which performs control so as to make a potential of the first node N3 equal to a potential of the second node N4. The resistor 25 is an exemplary third resistor of the present invention. The diodes D1 and D2 are an exemplary first diode and an exemplary second diode of the present invention, respectively.

The current-voltage conversion circuit 20 is composed of: a P-channel MOS transistor MP3 having a gate terminal of the same potential as the gate voltage and drain voltage of the P-channel MOS transistor MP2 in the current generation circuit 10; a resistor 26 of a resistance value R2 and a resistor 27 of a resistance value R3, which are connected in series between the drain of the P-channel MOS transistor MP3 and the ground, and through which current generated by the current generation circuit 10 flows; and an operational amplifier 70 used for impedance conversion. When the output from the drain of the P-channel MOS transistor MP3 is reference voltage Vref, the current-voltage conversion circuit 20 outputs this reference voltage Vref via an impedance converter composed of the operational amplifier 70. When it is assumed that the output of the operational amplifier 70 is output voltage Vout and there is no offset voltage of the operational amplifier 70, the output voltage Vout is equal to reference voltage Vref.

Here, the P-channel MOS transistor MP3 constitutes an input circuit, connected in series between a reference voltage node N5 of reference voltage Vref and a power source node, and receiving mirror current of the current mirror circuit of the current generation circuit 10. The resistor 26 is connected in series between the reference voltage node N5 and a third node N2; the resistor 27 is connected in series between the third node N2 and a ground node. Note that the resistors 26 and 27 are an exemplary first resistor and an exemplary second resistor of the present invention, respectively.

The relational expression of reference voltage Vref in the reference voltage generation circuit having the above configuration can now be determined. Here, it is assumed that the P-channel MOS transistors MP1 and MP2 constituting the first current mirror circuit of the current generation circuit 10 are equal in gate length and gate width, and N-channel MOS transistors MN1 and MN2 constituting the second current mirror circuit are equal in gate length and gate width.

When the Boltzmann constant is k, absolute temperature is T, and the elementary charge quantity of electron is q, source-drain current I2 of the P-channel MOS transistor MP2 is expressed as $$I2=(kT/q)\cdot\ln(N)/R1 \quad (6).$$

This current I2 is not dependent on the power source voltage, and is determined by physical constants, the resistance value R1, and the junction area ratio N between the diode D1 and diode D2.

The current I2 is also supplied to the resistors 26 and 27 by the P-channel MOS transistor MP3 constituting the first current mirror circuit. Consequently, reference voltage Vref is expressed as $$V\mathrm{ref}=(R2+R3)/R1\cdot(kT/q)\cdot\ln(N) \quad (7).$$

When the resistors 25, 26, and 27 have temperature characteristics, the temperature characteristic of reference voltage Vref is expressed as follows.

$$\partial V\mathrm{ref}/\partial T=[(R2+R3)/R1]\cdot(k/q)\cdot\ln(N)+\partial[(R2+R3)/R1]/\partial T\cdot(kT/q)\cdot\ln(N) \quad (8).$$

Here, when material selection is made so that one of the resistors 26 and 27 has a positive temperature coefficient and the other resistor has a negative temperature coefficient, and the sum of the temperature coefficients of the resistors 26 and 27 is thereby minimized, reference voltage Vref can be made to be hardly affected by ambient temperature T.

For example, when R1=3.0 kΩ, R2=12 kΩ, R3=11 kΩ, and the temperature slopes of the resistors 25, 26, and 27 are 10 Ω/° C., 5 Ω/° C., and −5 Ω/° C., respectively, and junction area ratio N is 8, then reference voltage Vref at 300 K is 0.4 V.

As described above, in the reference voltage generation circuit according to the present embodiment, reference voltage Vref is, for example, 0.4 V, which is equal to or less than the bandgap voltage (1.24 V) of silicon. Consequently, it is possible to supply reference voltage equal to or less than the bandgap voltage of silicon.

Also, in the reference voltage generation circuit according to the present embodiment, the temperature characteristic of reference voltage Vref is expressed as formula (8), and the sum of the temperature coefficients of the resistors 26 and 27 is minimized. Consequently, the variation (∂Vref/∂T) of reference voltage Vref with respect to ambient temperature T is reduced, and it is thus possible to supply reference voltage Vref relatively unaffected by ambient temperature.

In the reference voltage generation circuit according to the present embodiment, the operational amplifier 70 acting as an impedance converter is connected to the reference voltage node N5 to which the P-channel MOS transistor MP3 and the resistor 26 are connected. This is effective in transmitting voltage to the subsequent stage when the input impedance of a subsequent stage is low. However, when the input impedance of a subsequent stage is high, the operational amplifier 70 may does not need to be connected.

Second Embodiment

Figure 4:
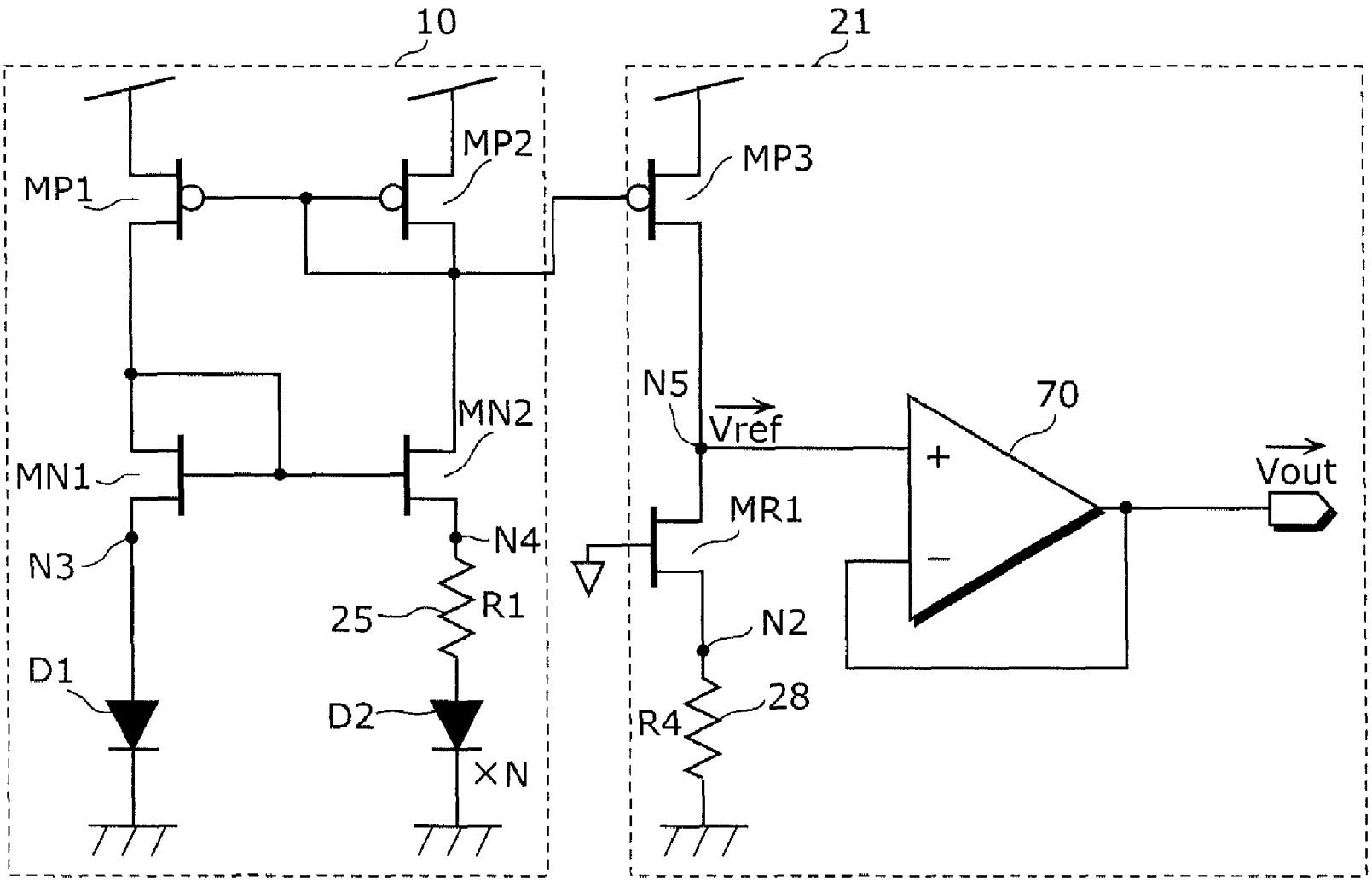
FIG. 4 is a circuit diagram illustrating a configuration of a reference voltage generation circuit according to a second embodiment of the present invention.

FIG. 4 is a circuit diagram of a reference voltage generation circuit according to the present embodiment. In FIG. 4, the same reference characters are applied to parts corresponding to those of FIG. 2, and a detailed explanation thereof is omitted.

This reference voltage generation circuit is different from the reference voltage generation circuit of the first embodiment in that the current-voltage conversion circuit has an N-channel MOS transistor MR1 instead of the resistor 26. The reference voltage generation circuit is composed of the current generation circuit 10 and a current-voltage conversion circuit 21 which converts current generated by the current generation circuit 10 into voltage to generate reference voltage.

The current-voltage conversion circuit 21 is composed of: the P-channel MOS transistor MP3; the N-channel MOS transistor MR1, which is connected to the drain of the P-channel MOS transistor MP3, and through which current generated by the current generation circuit 10 flows; a resistor 28 of a resistance value R4, which is connected between the source of the N-channel MOS transistor MR1 and the ground, and through which current generated by the current generation circuit 10 flows; and an operational amplifier 70. When the output from the drain of the P-channel MOS transistor MP3 is reference voltage Vref, the current-voltage conversion circuit 21 outputs this reference voltage Vref via an impedance converter composed of the operational amplifier 70. When it is assumed that the output of the operational amplifier 70 is output voltage Vout and there is no offset voltage of the operational amplifier 70, the output voltage Vout is equal to reference voltage Vref.

Here, assume that the N-channel MOS transistor MR1 operates in a non-saturation region. In this case, a resistance value RDS1 between the drain and source, i.e, a resistance value RDS1 of ON resistance can be varied by gate voltage, and the gate voltage is controlled by a bias circuit. The N-channel MOS transistor MR1 is connected in series between a reference voltage node N5 and a third node N2, and the resistor 28 is connected in series between the third node N2 and a ground node N2. Note that, the N-channel MOS transistor MR1 and the resistor 28 are an exemplary first resistor and an exemplary second resistor of the present invention.

The relational expression of reference voltage Vref in the reference voltage generation circuit having the above configuration can now be determined.

When the gate length of the N-channel MOS transistor MR1 is L1, the gate width is W1, the product of mobility and oxide film capacitance per unit area is K1, the gate-source voltage is VSG1, and the threshold voltage is VT1, resistance value RDS1 of ON resistance for the N-channel MOS transistor MR1 is expressed as $$RDS1=L1/\{K1\cdot W1\cdot(VGS1-VT1)\} \quad (9).$$

Meanwhile, reference voltage Vref of the current-voltage conversion circuit 21 is expressed as $$V\mathrm{ref}=(R4+RDS1)/R1\cdot(kT/q)\cdot\ln(N) \quad (10).$$

When it is assumed that the resistors 25 and 28, and ON resistance of the N-channel MOS transistor MR1 has temperature characteristics, the temperature characteristic of reference voltage Vref is expressed as $$\partial V\mathrm{ref}/\partial T=[(R4+RDS1)/R1]\cdot(k/q)\cdot\ln(N)+\partial[(R4+RDS1)/R1]/\partial T\cdot(kT/q)\cdot\ln(N) \quad (11).$$

Here, the temperature characteristic of ON resistance of the N-channel MOS transistor MR1 depends on threshold VT and the product of mobility and oxide film capacitance per unit area K; and ON resistance of a transistor operating in a non-saturation region generally has a positive temperature coefficient. Accordingly, when the resistor 28 is made of a material having a negative temperature coefficient, reference voltage Vref can be made non-sensitive to ambient temperature.

For example, when R1=1 kΩ, R4=1.9 kΩ, the gate width W1 of the N-channel MOS transistor MR1 is 1.6 μm, gate length L1 is 0.6 μm, the product of mobility and oxide film capacitance per unit area K is 100 $\mu A/V^2$, gate-source voltage VGS1 is 1.5 V, threshold voltage VT1 is 0.5 V, the temperature slopes of the resistor 25, ON resistance of the N-channel MOS transistor MR1, and the resistor 28 are 4 Ω/° C., −9 Ω/° C., and 4 Ω/° C., respectively, and junction area ratio N is 8, then reference voltage Vref at 300 K is 0.3 V.

As described above, according to the reference voltage generation circuit of the present embodiment, reference voltage Vref is, for example, 0.3 V, which is equal to or less than the bandgap voltage (1.24 V) of silicon. Consequently, it is possible to supply reference voltage equal to or less than the bandgap voltage of silicon.

Also, according to the reference voltage generation circuit of the present embodiment, the temperature characteristic of reference voltage Vref is expressed as formula (11); that is, the sum of temperature coefficients of the drain-source resistance of the N-channel MOS transistor MR1 and the resistor 28 is set small. Consequently, the variation (∂Vref/∂T) of reference voltage Vref with respect to ambient temperature T is reduced, so it is possible to supply reference voltage Vref relatively unaffected by ambient temperature.

Also, according to the reference voltage generation circuit of the present embodiment, the resistor 26 in the reference voltage generation circuit of the first embodiment is replaced with the N-channel MOS transistor MR1 operating in a non-saturation region. Consequently, the resistor requiring a large area on the chip can be replaced with the transistor occupying a relatively small area, so the chip area can be reduced.

In the reference voltage generation circuit of the present embodiment, the operational amplifier 70 acting as an impedance converter is connected to the reference voltage node N5 to which the P-channel MOS transistor MP3 and the N-channel MOS transistor MR1 are connected. This is effective in transmitting voltage to a subsequent stage when the input impedance of a subsequent stage is low. However, when the input impedance of a subsequent stage is high, the operational amplifier 70 does not need to be connected.

Also, in reference voltage generation circuit of the present embodiment, an N-channel MOS transistor is used as the transistor operating in a non-saturation region. However, a P-channel MOS transistor may be alternatively used.

Third Embodiment

Figure 5:
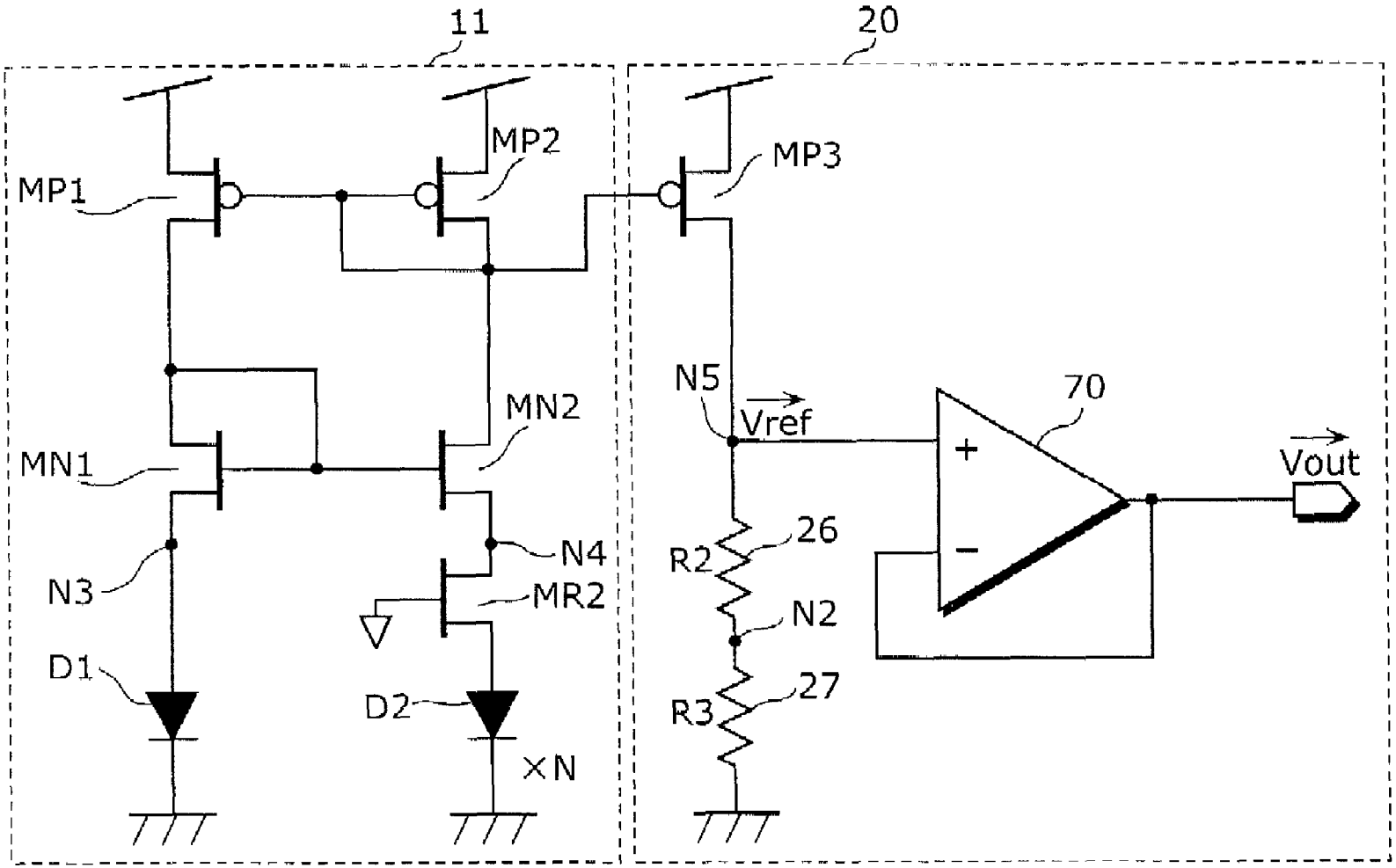
FIG. 5 is a circuit diagram illustrating a configuration of a reference voltage generation circuit according to a third embodiment of the present invention.

FIG. 5 is a circuit diagram of a reference voltage generation circuit according to the present embodiment. In FIG. 5, the same reference characters are applied to parts corresponding to those of FIG. 3, and a detailed explanation thereof is omitted.

This reference voltage generation circuit is different from the reference voltage generation circuit of the first embodiment in that the current generation circuit has an N-channel MOS transistor MR2 instead of the resistor R1. The reference voltage generation circuit is composed of: the current generation circuit 11 which generates current that varies in value according to the ambient temperature of the current generation circuit 11; and the current-voltage conversion circuit 20.

The current generation circuit 11 is composed of: P-channel MOS transistors MP1 and MP2; N-channel MOS transistors MN1 and MN2; a diode D1; and an N-channel MOS transistor MR2 and a diode P2 connected in series between the source of the N-channel MOS transistor MN2 and the ground.

Here, assume that the N-channel MOS transistor MR2 operates in a non-saturation region. In this case, a resistance value RDS2 between the drain and source, i.e, a resistance value RDS2 of ON resistance can be varied by gate voltage, and the gate voltage is controlled by a bias circuit. The N-channel MOS transistor MR2 is connected in series between a second node N4 and a ground node. Note that, the N-channel MOS transistor MR2 is an exemplary third resistor of the present invention.

The relational expression of reference voltage Vref in the reference voltage generation circuit having the above configuration can now be determined.

When the gate length of the N-channel MOS transistor MR2 is L2, the gate width is W2, the product of mobility and oxide film capacitance per unit area is K2, the gate-source voltage is VSG2, and the threshold voltage is VT2, resistance value RDS2 of ON resistance of the N-channel MOS transistor MR2 is expressed as $$RDS2=L2/\{K2\cdot W2\cdot(VGS2-VT2)\} \quad (12).$$

Meanwhile, reference voltage Vref of the current-voltage conversion circuit is expressed as $$Vref=(R2+R3)/RDS2\cdot(kT/q)\cdot\ln(N) \quad (13).$$

When it is assumed that the resistors 26 and 27, and ON resistance of the N-channel MOS transistor MR2 have temperature characteristics, the temperature characteristic of reference voltage Vref is expressed as $$\partial Vref/\partial T=[(R2+R3)/RDS2]\cdot(k/q)\cdot\ln(N)+\partial[(R2+R3)/RDS2]/\partial T\cdot(kT/q)\cdot\ln(N) \quad (14).$$

Here, when the sum of temperature coefficients of the resistors 26 and 27 is minimized, reference voltage Vref can be made to be hardly affected by ambient temperature T.

For example, when R2=1.9 kΩ, R3=3.75 kΩ, the gate width W2 of the N-channel MOS transistor MR2 is 6 μm, gate length L2 is 0.6 μm, the product of mobility and oxide film capacitance per unit area K is 100 $\mu A/V^2$, gate-source voltage VGS2 is 1.5 V, threshold voltage VT2 is 0.5 V, the temperature slopes of the resistors 26 and 27, and ON resistance of the N-channel MOS transistor MR2 are −2 Ω/° C., 4 Ω/° C., and −4 Ω/° C., respectively, and junction area ratio N is 8, then output voltage Vref at 300 K is 0.3 V.

As described above, according to the reference voltage generation circuit of the present embodiment, reference voltage Vref is, for example, 0.3 V, which is equal to or less than the bandgap voltage (1.24 V) of silicon. Consequently, it is possible to supply reference voltage equal to or less than the bandgap voltage of silicon.

Also, according to the reference voltage generation circuit of the present embodiment, due to the same reason as the reference voltage generation circuit of the first embodiment, it is possible to supply reference voltage Vref relatively unaffected by ambient temperature.

Also, according to the reference voltage generation circuit of the present embodiment, the resistor 25 in the reference voltage generation circuit of the first embodiment is replaced with the N-channel MOS transistor MR2 operating in a non-saturation region. Consequently, the resistor requiring a large area on the chip can be replaced with a transistor occupying a relatively small area, so the chip area can be reduced.

In reference voltage generation circuit of the present embodiment, an N-channel MOS transistor is used as a transistor operating in a non-saturation region. However, a P-channel MOS transistor may be alternatively used.

Fourth Embodiment

Figure 6:
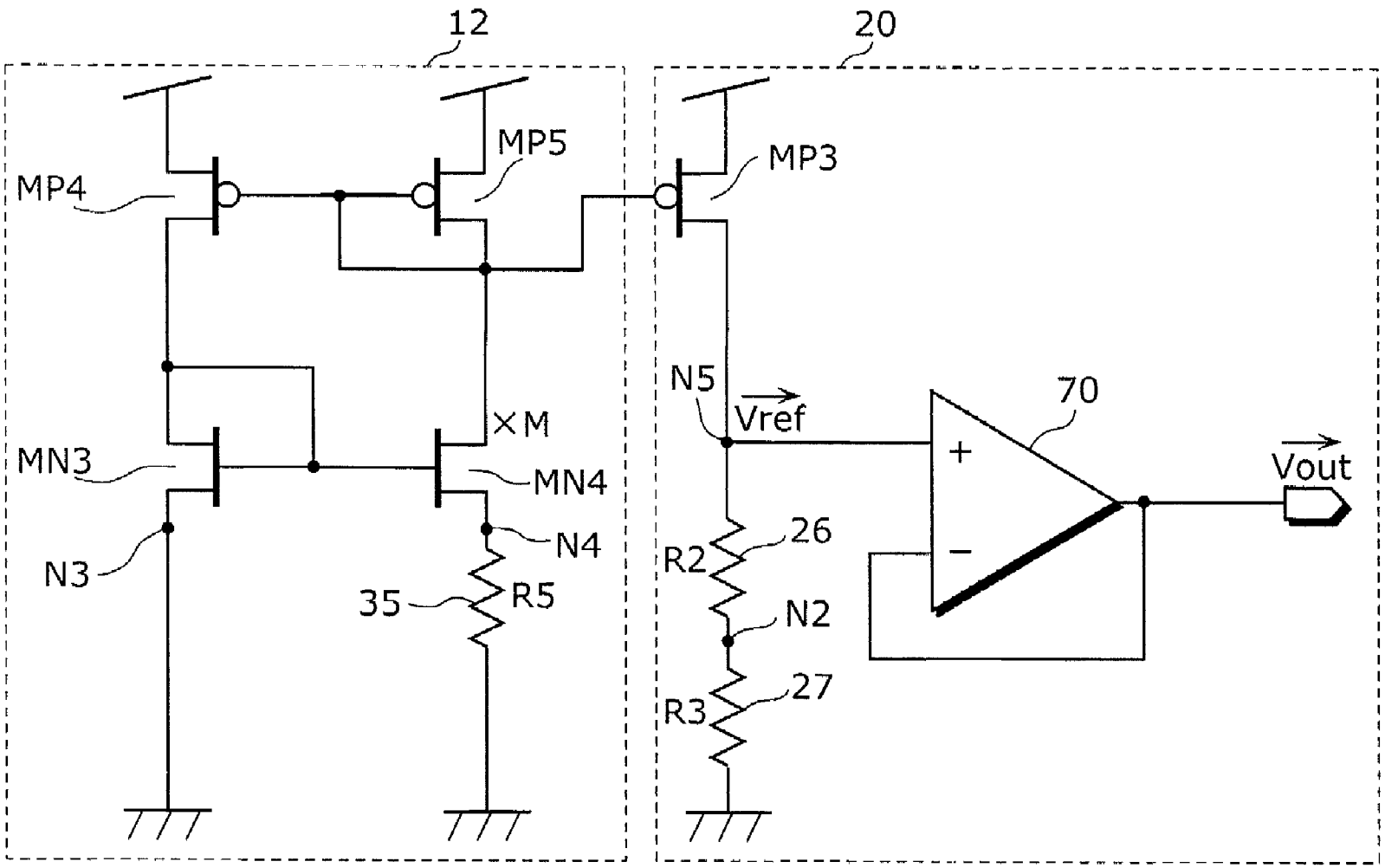
FIG. 6 is a circuit diagram illustrating a configuration of a reference voltage generation circuit according to a fourth embodiment of the present invention.

FIG. 6 is a circuit diagram of a reference voltage generation circuit according to the present embodiment. In FIG. 6, the same reference characters are applied to parts corresponding to those of FIG. 3, and a detailed explanation thereof is omitted.

This reference voltage generation circuit has a current generation circuit of a configuration different from that of the current generation circuit 10 of the first embodiment, and is composed of: a current generation circuit 12 which generates current which varies in value according to the ambient temperature of the current generation circuit 12; and the current-voltage conversion circuit 20.

The current generation circuit 12 is composed of: P-channel MOS transistors MP4 and MP5 constituting a first current mirror circuit; N-channel MOS transistors MN3 and MN4 constituting a second current mirror circuit; and a resistor 35 of a resistance value R5 connected in series between the source of the N-channel MOS transistor MN4 and the ground. Here, reference character M denotes the mirror ratio of the N-channel MOS transistor MN4 to the N-channel MOS transistor MN3 of the second current mirror circuit.

Here, a resistor 35 is connected in series between a second node N4 and a ground node. The resistor 35 is an exemplary fourth resistor of the present invention.

The relational expression of reference voltage Vref in the reference voltage generation circuit having the above configuration can now be determined.

When the gate length of the N-channel MOS transistor MN4 is L, the gate width is W, and the product of mobility and oxide film capacitance per unit area is K, current I1 flowing in the N-channel MOS transistor MN4 is expressed as $$I1=\{L/(K\cdot W\cdot(R5)^2)\}\cdot(1-(\sqrt{M})^{-1})^2 \quad (15).$$

This current I1 is supplied to the current-voltage conversion circuit 20 by the first current mirror circuit. Consequently, reference voltage Vref is expressed as $$V\mathrm{ref}=(R2+R3)\cdot\{L/(K\cdot W\cdot(R1)^2)\}\cdot(1-(\sqrt{M})^{-1})^2 \quad (16).$$

When the resistors 26, 27, and 35 have temperature characteristics, the temperature characteristic of reference voltage Vref is expressed as $$\partial Vref/\partial T=\left(1-(\sqrt{M})^{-1}\right)^2\cdot[\{\partial(R2+R3)/(R5)^2\}/\partial T\cdot L/(K\cdot W)+(R2+R3)/(R5)^2+\partial\{L/(K\cdot W)\}/\partial T]. \quad (17)$$

Here, when the sum of temperature coefficients of the resistors 26 and 27 is minimized, reference voltage Vref can be made to be hardly affected by ambient temperature T.

As described above, according to the reference voltage generation circuit of the present embodiment, due to the same reason as the reference voltage generation circuit of the first embodiment, it is possible to supply reference voltage equal to or less than the bandgap voltage of silicon.

Also, according to the reference voltage generation circuit of the present embodiment, the diode needed for the current generation circuit of the first embodiment can be omitted, and thus the reference voltage generation circuit can be constituted only of the resistors and transistors. Consequently, the chip area can be reduced. However, in this case, as indicated by formula (15), the variations in transistor manufacturing processes cause the current value of the current generation circuit to vary, so the output voltage and the temperature characteristics of output voltage are also affected by the variations in manufacturing processes.

Fifth Embodiment

Figure 7:
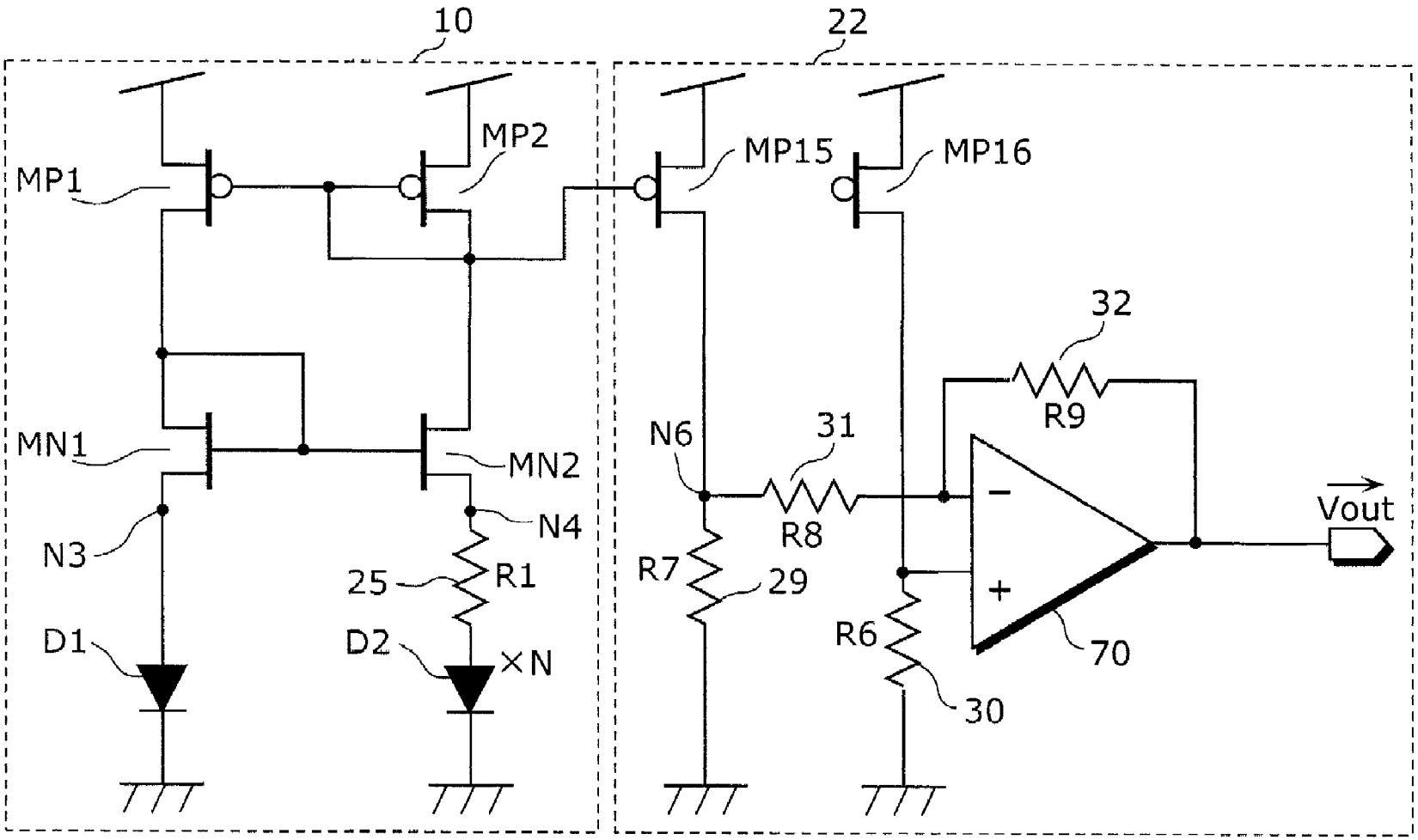
FIG. 7 is a circuit diagram illustrating a configuration of a reference voltage generation circuit according to a fifth embodiment of the present invention.

FIG. 7 is a circuit diagram of a reference voltage generation circuit according to the present embodiment. In FIG. 7, the same reference characters are applied to parts corresponding to those of FIG. 3, and a detailed explanation thereof is omitted.

This reference voltage generation circuit has a current-voltage conversion circuit of a configuration different from that of the current-voltage conversion circuit 20 of the first embodiment, and is composed of: the current generation circuit 10; and a current-voltage conversion circuit 22 which converts current generated by the current generation circuit 10 into voltage to generate reference voltage.

The current-voltage conversion circuit 22 is composed of: P-channel MOS transistors MP15 and MP16 having a gate terminal of the same potential as the gate voltage and drain voltage of the P-channel MOS transistor MP2 of the current generation circuit 10; a resistor 29 of a resistance value R7, which is connected between the drain of the P-channel MOS transistor MP15 and the ground, and through which current generated by the current generation circuit 10 flows; a resistor 30 of a resistance value R6, which is connected between the drain of the P-channel MOS transistor MP16 and the ground, and through which current generated by the current generation circuit 10 flows; a resistor 31 of a resistance value R8, which is connected between the drain of the P-channel MOS transistor MP15 and an inverting input terminal of an operational amplifier 70, and through which current generated by the current generation circuit 10 flows; and a resistor 32 of a resistance value R9 connected between the inverting input terminal of the operational amplifier 70 and an output terminal of the operational amplifier 70. Connected to a non-inverting input terminal of the operational amplifier 70 is the drain of the P-channel MOS transistor MP16.

Here, the P-channel MOS transistor MP15 constitutes a first input circuit, connected in series between a fourth node N6 and a power source node, and receiving mirror current of the current mirror circuit of the current generation circuit 10. The P-channel MOS transistor MP16 constitutes a second input circuit, connected in series between the non-inverting input terminal of the operational amplifier 70 and a power source node, and receiving mirror current of the current mirror circuit of the current generation circuit 10. The inverting input terminal of the operational amplifier 70 is connected to the fourth node N6. The resistor 30 is connected in series between the non-inverting input terminal of the operational amplifier 70 and a ground node. The resistor 29 is connected in series between the fourth node N6 and a ground node. The resistor 31 is connected in series between the inverting input terminal of the operational amplifier 70 and the fourth node N6. Note that the resistors 32, 30, 29, and 31 are exemplary fifth, sixth, seventh, and eighth resistors of the present invention.

Output voltage Vref in the reference voltage generation circuit having the above configuration is expressed as $$V\mathrm{ref}=[(R2+R4+R5)\cdot R3/(R2+R4)-R5\sim R4/(R2+R4)]\cdot(1/R1)\cdot kT/q\cdot\ln(N) \quad (18).$$

When the resistors 25, 29, 30, 31, and 32 have temperature characteristics, the temperature characteristic of reference voltage Vref is expressed as $$\partial V\mathrm{ref}/\partial T=\partial f\{(R7+R8+R9)\cdot R6/(R7+R8)-R9\cdot R8/(R7+R8)\}\cdot(1/R1)]/\partial T\cdot kT/q\cdot\ln(N)+[(R7+R8+R9)\cdot R6/(R7+R8)-R9\cdot R8/(R7+R8)]\cdot(1/R1)\cdot k/q\cdot\ln(N) \quad (19).$$

Here, in formula (19), when material selection is made so that at least one of the resistors 32, 30, 29, and 31 has a positive temperature coefficient and at least one of the other resistors has a negative temperature coefficient, and the value of ∂Vref/∂T of formula (19) is minimized, reference voltage Vref can be made to be hardly affected by ambient temperature T. For example, it is possible that the resistors 30 ad 31 are made of a material having a positive temperature coefficient and the resistors 29 and 32 are made of a material having a negative temperature coefficient, or that the resistors 29, 30, and 32 are made of a material having a positive temperature coefficient and the resistor 31 is made of a material having a negative temperature coefficient.

As described above, according to the reference voltage generation circuit of the present embodiment, due to the same reason as the reference voltage generation circuit of the first embodiment, it is possible to supply reference voltage which is relatively unaffected by ambient temperature and equal to or less than the bandgap voltage of silicon.

Also, according to the reference voltage generation circuit of the present embodiment, the output voltage can be controlled by varying four resistance values of the resistors 29, 30, 31, and 32. Thus, the degree of freedom in selecting a resistance value can be increased.

Sixth Embodiment

Figure 8:
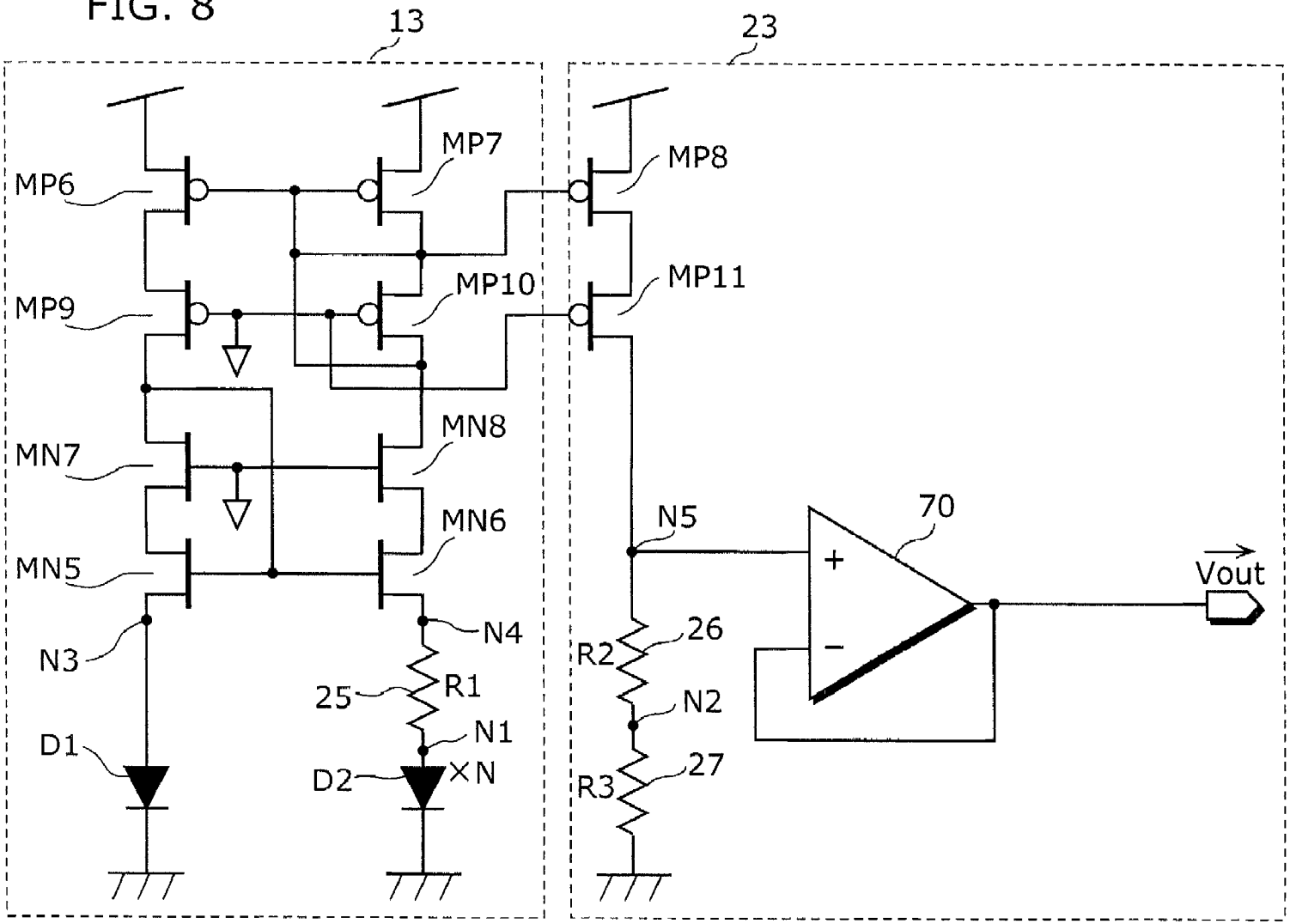
FIG. 8 is a circuit diagram illustrating a configuration of a reference voltage generation circuit according to a sixth embodiment of the present invention.

FIG. 8 is a circuit diagram of a reference voltage generation circuit according to the present embodiment. In FIG. 8, the same reference characters are applied to parts corresponding to those of FIG. 3, and a detailed explanation thereof is omitted.

This reference voltage generation circuit is different from the reference voltage generation circuit of the first embodiment in that the current mirror circuit of the current generation circuit has a cascode current mirror configuration in order to improve the accuracy of the current mirror circuit. The reference voltage generation circuit is composed of: a current generation circuit 13 which generates current that varies in value according to the ambient temperature of the current generation circuit 13; and a current-voltage conversion circuit 23 which converts current generated by the current generation circuit 13 into voltage to generate resistance value.

The current generation circuit 13 is composed of: P-channel MOS transistors MP6, MP7, MP9, and MP10 constituting a first current mirror circuit; N-channel MOS transistors MN5, MN6, MN7, and MN8 constituting a second current mirror circuit; a diode D1 connected between the source of the N-channel MOS transistor MN5 and the ground; and a resistor 25 of a resistance value R1 and a diode D2 connected in series between the source of the N-channel MOS transistor MN6 and the ground.

Here, the first and second current mirror circuits are connected in series between a power source node and a first node N3 and between a power source node and a second node N4, and controlled so that current flowing in the second node N4 becomes an integer multiple of current flowing in the first node N3. The first and second current mirror circuits constitute a feedback circuit which performs control so as to make the potential of the first node N3 equal to that of the second node N4.

The current-voltage conversion circuit 23 is composed of: P-channel MOS transistors MP8 and MP11 constituting the first current mirror circuit; a resistor 26 of a resistance value R2 and a resistor 27 of a resistance value R3; and an operational amplifier 70. When the output from the drain of the P-channel MOS transistor MP11 is reference voltage Vref, the current-voltage conversion circuit 23 outputs this reference voltage Vref via an impedance converter composed of an operational amplifier 70.

Here, in order to suppress the drain voltage variations of the P-channel MOS transistors MP6, MP7, and MP8, the P-channel MOS transistors MP9, MP10, and MP11 are cascode-connected to the P-channel MOS transistors MP6, MP7, and MP8. The gate voltages of the P-channel MOS transistors MP9, MP10, and MP11 are controlled by a bias circuit being a separate circuit so that the first current mirror circuit operates in a saturation region.

Similarly, in order to improve the accuracy of the second current mirror circuit, the N-channel MOS transistors MN7 and MN8 are cascode-connected to the N-channel MOS transistors MN5 and MN6. The gate voltages of the N-channel MOS transistors MN7 and MN8 are controlled by a bias circuit being a separate circuit so that the second current mirror circuit operates in a saturation region.

The P-channel MOS transistors MP8 and MP11 are connected in series between a reference voltage node N5 and a power source node, and constitute an input circuit which receives mirror current of the current mirror circuit of the current generation circuit 13.

Generally, the current mirror circuit has mirror loss ΔIe, and mirrored current of reference current Iref is Iref+ΔIe. The occurrence of this mirror loss is ascribable to the fact that the drain voltages of two transistors constituting the current mirror circuit are different when the two transistors operate. Consequently, when the first and second current mirror circuits constitute a cascode current mirror circuit, the variations of drain voltage of transistors constituting the first and second current mirror circuits can be suppressed. As a result, in the first and second current mirror circuits, ΔIe can be reduced, and mirror accuracy improvement and output voltage accuracy improvement can thus be implemented.

Reference voltage Vref in the reference voltage generation circuit having the above configuration is expressed as a formula similar to formula (7), and its temperature characteristic is expressed as a formula similar to formula (8). Consequently, when material selection is made so that one of the resistors 26 and 27 has a positive temperature coefficient and the other resistor has a negative temperature coefficient, and the sum of the temperature coefficients of the resistors 26 and 27 is thereby minimized, then reference voltage Vref can be made to be hardly affected by ambient temperature T.

As described above, according to the reference voltage generation circuit of the present embodiment, due to the same reason as the reference voltage generation circuit of the first embodiment, it is possible to supply reference voltage which is relatively unaffected by ambient temperature and equal to or less than the bandgap voltage of silicon.

Note that, in the reference voltage generation circuit of the present embodiment, the cascode current mirror configuration of the first and second current mirror circuits is not limited to the configuration illustrated in FIG. 8, as long as the variations of drain voltage of transistors constituting the first and second current mirror circuits are suppressed.

The reference voltage generation circuit according to the present invention has been described above with reference to the embodiments, but it is to be understood that the present invention is not limited to these embodiments. Various modifications conceived by a person skilled in the art without departing from the concept of the invention, are also included in the technical scope of the invention.

For example, the resistor of a positive temperature coefficient and the resistor of a negative temperature coefficient may be any of a variable resistor and a trimming circuit, respectively.

Although only some exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention.

INDUSTRIAL APPLICABILITY

The present invention is useful in a reference voltage generation circuit, and more particularly in a reference voltage generation circuit or the like constituting a power source circuit or constant-voltage circuit.

What is claimed is:

1. A reference voltage generation circuit, comprising:

a current generation circuit which generates current and that includes: a first diode connected in series between a first node and a ground node; a second diode and a third resistor connected in series between a second node and a ground node; and a feedback circuit, connected in series between a power source node and the first node and between a power source node and the second node, and performing control so as to make a potential of the first node equal to a potential of the second node, a current-voltage conversion circuit which converts the current generated by said current generation circuit into voltage to generate reference voltage and includes an input circuit, connected in series between a reference voltage node which generates reference voltage and a power source node, into which the current generated by said current generation circuit is inputted, wherein said current generation circuit generates current which varies in value according to ambient temperature of said current generation circuit, wherein said current-voltage conversion circuit has a first resistor and a second resistor in which the current generated by the said current generation circuit flows, said first resistor being connected in series between the reference voltage node and a third node and said second resistor being connected in series between the third node and a ground node, and wherein one of said first resistor and said second resistor has a positive temperature coefficient and the other has a negative temperature coefficient.

2. The reference voltage generation circuit according to claim 1, wherein at least one of said first resistor and said second resistor is a transistor which operates in a non-saturation region.

3. The reference voltage generation circuit according to claim 1, wherein said third resistor is a transistor which operates in a non-saturation region.

4. A reference voltage generation circuit, comprising:

a current generation circuit which generates current and that includes: a current mirror circuit which is connected in series between a first node and a power source node and between a second node and a power source node and which performs control so that current flowing in the second node becomes an integer multiple of current flowing in the first node; and a fourth resistor connected in series between the second node and a ground node; and a current-voltage conversion circuit which converts the current generated by said current generation circuit into voltage to generate reference voltage, said current-voltage conversion circuit further including an input circuit, connected in series between a reference voltage node which generates reference voltage and a power source node, into which mirror current of said current mirror circuit is inputted, wherein said current generation circuit generates current which varies in value according to ambient temperature of said current generation circuit, wherein said current-voltage conversion circuit has a first resistor and a second resistor in which the current generated by the said current generation circuit flows, said first resistor being connected in series between the reference voltage node and a third node and said second resistor being connected in series between the third node and a ground node, wherein one of said first resistor and said second resistor has a positive temperature coefficient and the other has a negative temperature coefficient.

5. A reference voltage generation circuit, comprising:

a current generation circuit which generates current; and a current-voltage conversion circuit which converts the current generated by said current generation circuit into voltage to generate reference voltage, wherein said current generation circuit generates current which varies in value according to ambient temperature of said current generation circuit, said current-voltage conversion circuit has a first resistor and a second resistor in which the current generated by the said current generation circuit flows, and one of said first resistor and said second resistor has a positive temperature coefficient and the other has a negative temperature coefficient, wherein at least one of said resistor having the positive temperature coefficient and said resistor having the negative temperature coefficient is any of a variable resistor and a trimming circuit.

6. A reference voltage generation circuit comprising:

a current generation circuit which generates current; and a current-voltage conversion circuit which converts the current generated by said current generation circuit into voltage to generate reference voltage, wherein said current generation circuit is a circuit that generates current which varies in value according to an ambient temperature of said current generation circuit, said current generation circuit includes: a first diode connected in series between a first node and a ground node; a second diode and a third resistor connected in series between a second node and a ground node; and a feedback circuit, connected in series between a power source node and the first node and between a power source node and the second node, and performing control so as to make a potential of the first node equal to a potential of the second node, and said current-voltage conversion circuit includes: a first input circuit connected in series between a fourth node and a power source node and into which the current generated by said current generation circuit is inputted; an operational amplifier having an inverting input terminal connected to the fourth node; a second input circuit, connected in series between a non-inverting input terminal of the operational amplifier and a power source node, and receiving the current generated by said current generation circuit; a fifth resistor connected between the inverting input terminal and an output terminal of the operational amplifier; a sixth resistor connected in series between the non-inverting input terminal of the operational amplifier and a ground node; a seventh resistor connected in series between the fourth node and a ground node; and an eighth resistor connected in series between the fourth node and the inverting input terminal of said operational amplifier, and at least one of the fifth resistor, the sixth resistor, the seventh resistor, and the eighth resistor has a positive temperature coefficient, and at least one of the other resistors has a negative temperature coefficient.

7. The reference voltage generation circuit according to claim 6, wherein at least one of said resistor having the positive temperature coefficient and said resistor having the negative temperature coefficient is any of a variable resistor and a trimming circuit.

* * * * *